United States Patent [19]

Holmberg

[11] Patent Number: 4,525,116

[45] Date of Patent: Jun. 25, 1985

[54] PREFABRICATED BINDABLE SHEET AND BINDING METHOD AND APPARATUS

[75] Inventor: Albert E. Holmberg, Edina, Minn.

[73] Assignee: The Holmberg Company, Minneapolis, Minn.

[21] Appl. No.: 453,814

[22] Filed: Dec. 27, 1982

[51] Int. Cl.[3] ..... B42C 9/00; B42B 9/06; B42B 13/00

[52] U.S. Cl. ..... 412/8; 412/6; 412/33; 412/900; 412/902; 281/2; 281/21 R; 281/38; 283/61

[58] Field of Search ..... 281/2, 38, 21 R; 283/61; 412/6, 8, 33, 900, 902

[56] References Cited

U.S. PATENT DOCUMENTS

| | | | |
|---|---|---|---|
| 3,730,512 | 5/1973 | Bellanca | 412/6 |
| 3,793,016 | 2/1974 | Eichorn | 281/21 R X |
| 3,794,550 | 2/1974 | Taillie | 281/21 R |
| 4,153,276 | 5/1979 | Ohlsson | 412/8 X |
| 4,315,697 | 2/1982 | Horowitz | 281/38 X |
| 4,343,673 | 8/1982 | Smith, Jr. et al. | 412/33 X |

*Primary Examiner*—Paul A. Bell
*Assistant Examiner*—Taylor J. Ross

[57] ABSTRACT

A prefabricated bindable sheet having heat-responsive glue applied along one edge and a method for binding such sheets together which includes the steps of providing sheets of paper having segments of heat-responsive glue applied along one edge thereof, producing the desired information on said sheets, assembling said sheets with the glue edges in registration, pressing the registered glue edges of the assembled sheets together while applying heat to the edge thereof and alternatively, a method wherein at least certain of said sheets are double size to provide pairs of sheets connected by a fold line wherein the glue is applied to the outside of said pair of sheets along said fold line; and apparatus for attaching sheets together which includes means for clamping a plurality of sheets together which have heat-responsive glue applied along the attachment edges thereof and heating means for applying heat to the glue edges to positively connect said sheets together.

11 Claims, 9 Drawing Figures

PREFABRICATED BINDABLE SHEET AND BINDING METHOD AND APPARATUS

BACKGROUND OF THE INVENTION

In the past, small booklets of sheets of paper have been bound together by stapling, brads or fasteners which extend through preformed holes provided along the attachment edges. This is in contrast to a conventional binding operation where the sheets are bound together by glue which is applied to the edges to be bound and thereafter, the covers (if any) are applied. The concept of the present invention is to preapply a heat-responsive ribbon of glue along an edge of the sheets to be bound together, so that after the desired information has been written or printed on the sheet either by a copying process, typewriting, word processing printer, or otherwise, any selected number of sheets can be neatly and quickly bound together by clamping the sheets together and applying heat to the glue edges thereof to activate the glue and bind adjacent sheet surfaces together. This eliminates the problems incurred with stapling and other presently known attachment methods.

SUMMARY OF THE INVENTION

This invention includes the preapplication of a strip of heat-responsive thermosetting glue to the edge portion of the sheets to produce a bindable sheet which can be run through a copy machine, a typewriter, a word processing printer, or merely handwritten memoranda applied thereto and thereafter, the desired sheets may be quickly and easily assembled and bound together into a neat booklet formed by applying heat to the edge of the assembled sheets while the same are securely pressed together. An alternative form of the invention includes the provision of a fold line extending down the center of a double size sheet with the heat-responsive glue preapplied adjacent to the fold line so that after the desired information is produced on the surfaces of the double size sheet as by copying, "2-up" on both sides of the sheet, the sheet may be folded to position the glue strip adjacent the folded edge and the folded double sheets can then be quickly and easily bound together by applying heat to the adhesive edges thereof while clamping and binding the double sheets together in a manner to permit the inside of each fold line to be free from glue and thus, provide a substantially free, unobstructed hinge joint between the adjacent folded sheets, while attaching the outside sheet surfaces to the glue edges of adjacent sheets. A modification of the alternative form of the invention is illustrated in FIG. 7 and provides a double glue strip on both sides of the fold line of the double size sheet. FIG. 8 illustrates still another form of the invention where both sides of a single sheet have a strip of glue applied along the glue edge thereof.

Apparatus for heating and clamping the heat-responsive glued sheets together is also illustrated in FIGS. 1 and 2.

and

Figure 8:
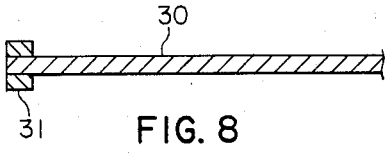
Figure 9:
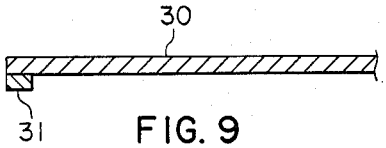

FIG. 8 is a vertical sectional view of a fourth form of the invention;

FIG. 9 is a vertical sectional view of a fifth form of the invention.

DETAILED DESCRIPTION OF THE DISCLOSED EMBODIMENTS

Figure 1:
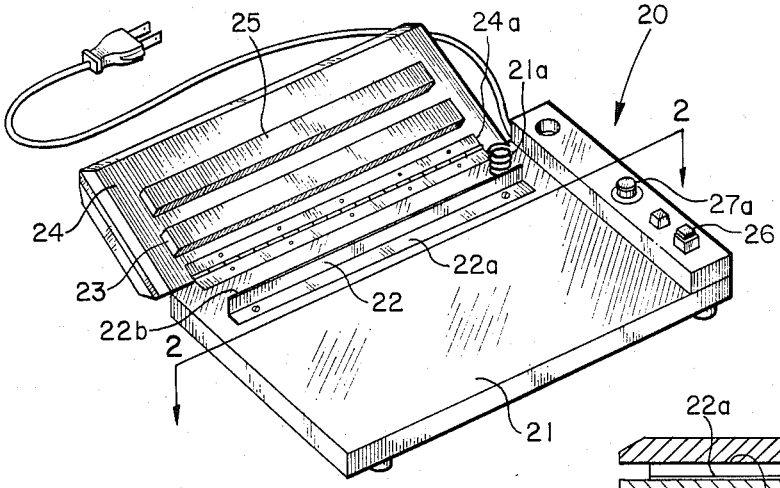
FIG. 1 is a perspective view showing apparatus for producing the heat-responsive binding operation.
Figure 2:
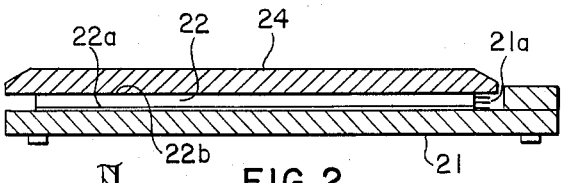
FIG. 2 is a sectional view of the apparatus shown in FIG. 1.
Figure 3:
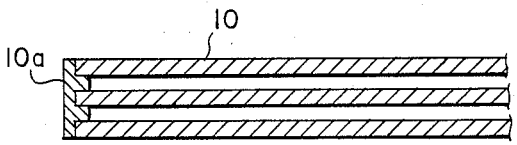
FIG. 3 is a sectional view showing one form of my invention.

As illustrated in FIG. 3, one form of the invention is shown. In this form of the invention, each sheet or layer 10 is provided with a ribbon 10*a* of a conventional glue which can be activated by the application of heat such as Formula No. S6930 manufactured and sold by H. B. Fuller Co., St. Paul, Minn. and also including but not limited to a hot melt adhesive marketed by the National Starch and Chemical Corporation of Bridgewater, N.J. under their trademark INSTANT-LOK® No. 34-2950, as well as a number of other readily available suitable glue products. The individual sheets 10 with the glue ribbon 10*a* applied thereto are prepared by a manufacturer and sold as blank sheets to which information may be applied in any conventional manner, such as by copying on a conventional copy machine, typing on a typewriter, printing from a word or data processor, or merely handwritten notes and memoranda. Then these sheets may be quickly and neatly bound together along the glue edges thereof by inserting a multiplicity of sheets 10 to be bound into a binding machine 20 as illustrated in FIGS. 1 and 2.

The binding machine 20 has a bottom pressure plate 21 with a top pressure plate 24 hingedly mounted thereon as by the hinge 24*a*. A spring 21*a* normally holds the top pressure plate in raised position. The bottom heater bar 22 is in the form of an angle member with a horizontal portion 22*a* mounted on the bottom pressure plate 21 and an upstanding paper abutment portion 22*b* extending upwardly therefrom to engage and position the assembled paper sheets inserted between the two pressure plates 21 and 24. A top heater bar 23 is mounted on the top pressure plate 24 above the heater bar 22 and both bars 22 and 23 may be coated with a non-stick surface such as Teflon to prevent glue from adhering thereto. A top clamping bar 25 is also mounted in the top pressure plate 24 on the opposite side of the heater bar 23 from the hinge 24*a* to securely clamp the assembled sheets down against the top surface of the bottom pressure plate 21 during the binding operation. An on-off switch 26 is provided for energizing the heater bars 22 and 23 which may be thermostatically controlled by a variable thermostat (not shown) of conventional design with a temperature control knob 27*a*.

Figure 4:
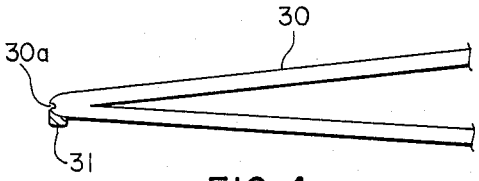
FIG. 4 is an end elevational view showing another form of my invention.
Figure 5:
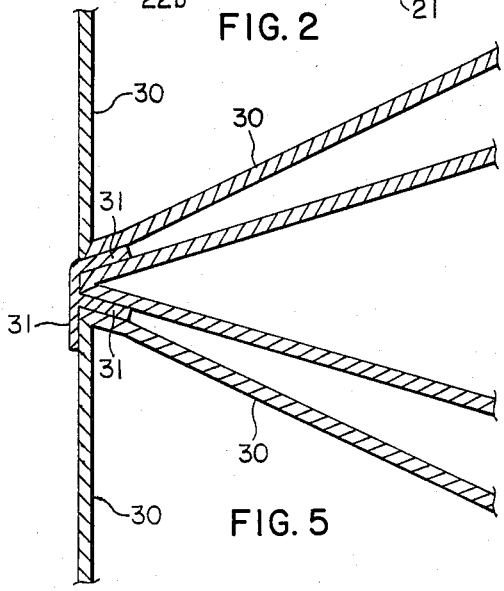
FIG. 5 is a sectional view of the form of the invention shown in FIG. 4 showing a plurality of double sheets connected together.
Figure 6:
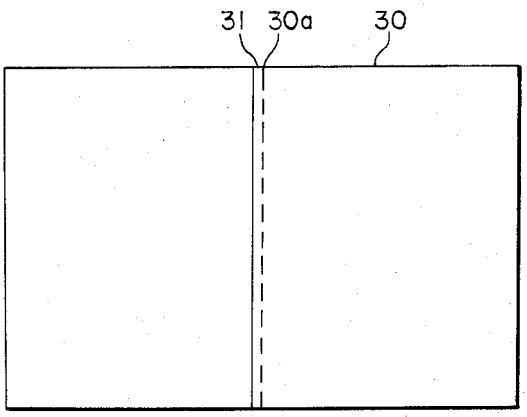
FIG. 6 is a top plan view showing a double sheet before folding.

Another form of the invention is illustrated in FIGS. 4, 5, and 6 wherein double size sheets 30 are initially produced with a fold or score line 30*a* extending down the center thereof. A ribbon of heat-responsive glue 31 is applied along one side of the fold line adjacent thereto so that when the sheet has been folded along said fold line 30*a*, the ribbon of glue will be disposed along the folded edge of the double sheet. This permits the double size sheet to be prrinted or copied 2-up on each side (before folding) while still permitting the folded double sheet to be bound together with other double sheets or with single sheets as desired. This is accomplished by assembling the folded sheets with or without single sheets interposed therebetween and inserting the glue edges of the folded sheets between the pressure plates 21 and 24 of the binding machine 20.

The heater bars 22 and 23 heat the folded glue edges to activate the glue and securely bind adjacent glue edges together. The inside edge surfaces of each double sheet assembly are free from glue. This produces a free, unrestricted hinge joint between the two layers attached only by the fold line 30*a*. The glued-together joint between adjacent outer surfaces of the folded sheets 30 is more restrictive because the glue ribbon extends inwardly from the edges a slight distance as shown. It is also apparent that a single sheet 10 may be interposed between two pairs of folded sheets (not illustrated). The fold line 30*a* can be formed in any conventional manner such as by the score line 30*a* shown in the drawings.

Since the fold line 30*a* forms the only binding between adjacent sheets, the fold line 30*a* must be sufficiently durable to prevent the sheets from separating during use.

Figure 7:
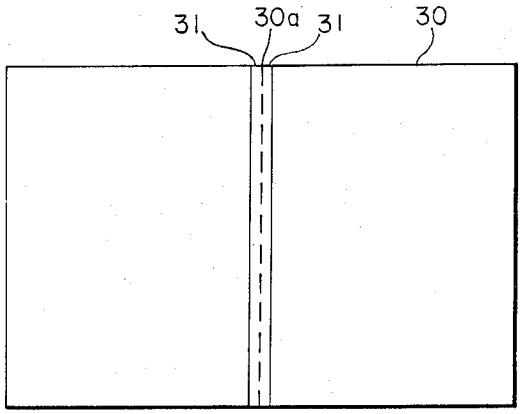
FIG. 7 is a top plan view of a third form of the invention.

A third form of the prefabricated bindable sheets is illustrated in FIG. 7 wherein the glue strip 31 is applied across the center fold line of the double sheets 30 so that two glue strips 31 are provided. A score line 30*a* cuts through the layer of glue, dividing it into two glue strips 31 as shown. The paper is also scored along line 30*a* to permit easy folding of the double sheet along the center fold line 30*a*.

Still another form of the invention is illustrated in FIG. 8 where a ribbon of glue 32 is applied to both sides of a single sheet 33. This permits a bound-together booklet to be separated and the sheet 33 inserted between the two separated sections and rebound by inserting the entire booklet into the binding apparatus.

It will be seen that an extremely simple, yet highly efficient method has been provided which permits the user to bind together previously printed sheets into a booklet which produces a neater and stronger, more durable binding method than stapling or other conventional methods. This neatly bound booklet can be produced quickly and easily as an inline operation to a copying or reproduction process.

What is claimed is:

1. A method for producing paper sheets adapted to be connected together comprising, providing double size sheets of paper, producing a predetermined fold line dividing said double size sheet into two single size sheets, and applying heat-responsive glue to said double size sheets adjacent said fold line on at least one side thereof.

2. The method set forth in claim 1 wherein said sheets are bound together, applying segments of glue along both sides of the fold line of said double size sheets, producing a score line through the glue in each sheet along the fold line thereof to provide a center fold line and permit the double size sheet to be printed, 2-up, on each side thereof and subsequently folded along said fold line to provide a double sheet assembly and expose glue segments on both sides of said fold line on the outside of the double sheet assembly, and binding a plurality of the double sheets by pressing the glue segments together and applying heat thereto.

3. The method set forth in claim 1 and producing the desired information on said sheets prior to assembling the sheets together.

4. The method set forth in claim 2 wherein said sheets are bound together and producing the desired information on said double size sheets 2-up on each side, folding said sheets along the fold line to form a double sheet assembly with information thereon, assembling said sheets with the glue edges in registration, and binding said assembled double sheets together by applying heat and pressure to the glue edge whereby the fold line forms a substantially unrestricted hinge connection between the two individual sheets connected thereby and the glue connects the double sheet assemblies together.

5. The method set forth in claim 4 wherein the glue segments are applied along both sides of said fold line to provide a glue to glue connection between adjacent double sheet assemblies when the heat and pressure are applied to the glue edges thereof.

6. The method set forth in claim 4 wherein the steps of applying heat and pressing the glue edges of the assembled sheets together are conducted simultaneously.

7. A continuous method for producing a bound booklet of sheets of paper with printed information on the sheets wherein said sheets are formed from a sheet of paper which is double the size of the ultimate sheet size to be produced and which has a fold line extending across the center of the sheet to designate the ultimate sheet size and which double sheet also has segments of heat-responsive glue along said fold line, said method comprising, producing printed information on said double size sheet so that two individual sheets are simultaneously printed, folding each double size sheet along said fold line to form a double sheet assembly wherein said fold line forms the hinge connection between said two sheets with said blue segments being positioned on the outside of said folded double sheet assembly, assembling said folded sheets with other printed sheets with the glue edges along said fold line being in registration with the edges of adjacent sheets to be bound thereto, pressing said glue edges together, and applying heat thereto while said sheets are pressed together to activate the glue and bind sheets to said folded sheet assembly while leaving the inside of the fold line free from glue to produce a substantially unrestricted hinge connection between the individual sheets of said folded double sheet assembly within the bound booklet.

8. The method set forth in claim 7 wherein said printed information is reproduced, 2-up, on a copy machine prior to folding the double size sheet.

9. A prefabricated paper sheet readily bindable into a multiple page booklet and comprising, a double size sheet, a fold line formed across the center of said sheet to divide the same into a pair of sheets, heat-responsive glue segments applied to said paper sheet along a binding line which forms the edge of a bound booklet when assembled with other sheets and which is readily bindable by applying heat and pressure to the glue segments of the assembled sheets, said glue segments being applied to said sheet adjacent said fold line in a manner to expose said glue segments when the double sheet is folded along said fold line.

10. The structure set forth in claim 9 wherein said glue segments are applied to both sides of said fold line.

11. The structure set forth in claim 9 wherein said glue segments are applied to both sides of said paper sheet along the fold line thereof.

* * * * *